US008668193B2

(12) United States Patent
Sasaki et al.

(10) Patent No.: US 8,668,193 B2
(45) Date of Patent: Mar. 11, 2014

(54) SHEET PROCESSING APPARATUS AND IMAGE FORMING SYSTEM

(75) Inventors: Kei Sasaki, Miyagi (JP); Nobuyoshi Suzuki, Tokyo (JP); Kiyoshi Hata, Tokyo (JP); Shingo Matsushita, Tokyo (JP); Makoto Hidaka, Tokyo (JP); Takashi Saito, Kanagawa (JP); Takamasa Matsumoto, Miyagi (JP); Akihiro Musha, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/471,940

(22) Filed: May 15, 2012

(65) Prior Publication Data

US 2012/0294695 A1 Nov. 22, 2012

(30) Foreign Application Priority Data

May 16, 2011 (JP) ..... 2011-109559

(51) Int. Cl.
*B65H 9/10* (2006.01)

(52) U.S. Cl.
USPC ..... 270/58.07; 270/58.12; 270/58.17

(58) Field of Classification Search
USPC ..... 270/32, 45, 58.07, 58.12, 58.17, 58.27; 412/16, 22; 399/407
See application file for complete search history.

(56) References Cited

U.S. PATENT DOCUMENTS

| | | | | |
|---|---|---|---|---|
| 6,145,825 | A * | 11/2000 | Kunihiro et al. | 270/58.09 |
| 6,575,447 | B2 * | 6/2003 | Yoshie et al. | 270/58.07 |
| 7,255,337 | B2 * | 8/2007 | Wakabayashi et al. | 270/37 |
| 7,805,106 | B2 * | 9/2010 | Kikuchi | 399/385 |
| 7,832,716 | B2 * | 11/2010 | Wakabayashi et al. | 270/37 |
| 2009/0258774 | A1 | 10/2009 | Suzuki et al. | |
| 2010/0148417 | A1 | 6/2010 | Suzuki et al. | |
| 2010/0239393 | A1 | 9/2010 | Suzuki et al. | |
| 2010/0310340 | A1 | 12/2010 | Suzuki et al. | |
| 2011/0103863 | A1 | 5/2011 | Asami et al. | |
| 2011/0103921 | A1 | 5/2011 | Suzuki et al. | |
| 2011/0229287 | A1 | 9/2011 | Suzuki | |
| 2012/0087765 | A1 | 4/2012 | Suzuki | |

FOREIGN PATENT DOCUMENTS

| | | | |
|---|---|---|---|
| JP | 2001-240296 | A | 9/2001 |
| JP | 2004-196494 | A | 7/2004 |
| JP | 2005-263404 | A | 9/2005 |
| JP | 4236136 | B2 | 12/2008 |

* cited by examiner

*Primary Examiner* — Leslie A Nicholson, III
(74) *Attorney, Agent, or Firm* — Harness, Dickey & Pierce, P.L.C.

(57) ABSTRACT

A sheet processing apparatus includes a conveying unit that conveys a booklet formed by folding a sheet bundle; a processing unit that performs a predetermined process on the booklet; a booklet holding unit that includes first and second holding members to hold the booklet and varies a gap distance between the first and second holding members depending on a state of processing the booklet while the sheet processing unit is performing the process on the booklet; and a pressing unit that presses and fixes the booklet while the processing unit is processing the booklet.

9 Claims, 13 Drawing Sheets

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2011-109559 filed in Japan on May 16, 2011.

BACKGROUND OF THE INVENTION

1. Field of the Invention

The present invention relates to a sheet processing apparatus and an image forming system.

2. Description of the Related Art

There are widely known sheet processing apparatuses disposed on the downstream side of a main body of an image forming apparatus and performing post-processing such as binding recording sheets or the like output from the image forming apparatus. Nowadays, such sheet processing apparatuses have been multifunctionalized, and generally perform not only conventional edge binding but also saddle-stitching and bookbinding. To further improve output quality in the saddle-stitching and bookbinding, there are sheet processing apparatuses that cut the edge of a bound booklet after the bookbinding using a cutter.

In the cutting process of such a cutter, the booklet is conveyed by a conveying unit such as a belt, and positioned by abutting the booklet on abutting stoppers placed in accordance with the size and cutting amount of the booklet. Thereafter, the booklet is fixed by being pressed by a pressing unit, and cut at the edge thereof by a cutting unit. By this operation, the bound booklet is trimmed at the edge thereof.

However, in conventional cutters, because the conveying unit such as a belt is rotating in the state in which the booklet is abutted on the positioning stopper, deflection of a surface sheet occurs. Fixing and cutting the booklet in this state can lead to misalignment at the edge after the cutting process. In addition, during the processes of flatting bulges of the booklet and applying pressure to the booklet, the surface or the spine side of the booklet may be deflected, and moreover, the booklet may move back and forth and be pressed in a displaced state. If the cutting process is performed in this state, misalignment occurs at the edge of the booklet after the process.

For that reason, for example, an invention disclosed in Japanese Patent Application Laid-open No. 2004-196494 is known as a device that performs cutting so as not to produce such deflection. In this invention, after sheets are folded and before the sheets are fixed by being pressed by a bundle pressing member, a plate, a roller, or the like gradually applies pressing force from the spine side (for example, an edge on the side on which the folding process has been performed) of the sheets while moving toward an edge surface so that no deflection is produced between the pressed position and the spine side of the sheets.

However, although the invention disclosed in Japanese Patent Application Laid-open No. 2004-196494 enables straightening of the deflection of the booklet, the booklet may move in the edge surface direction when the pressing force is applied for holding the booklet. If the booklet moves in the edge surface direction and is cut in that state, the booklet is trimmed with a cut surface thereof inclined. If the booklet is trimmed in such a manner, cutting accuracy cannot be improved even if the deflection is straightened.

Therefore, there is a need to suppress such deflection and to prevent misalignment from occurring when a booklet is pressed, whereby accurate sheet processing can be performed.

SUMMARY OF THE INVENTION

According to an embodiment, there is provided a sheet processing apparatus includes a conveying unit that conveys a booklet formed by folding a sheet bundle; a processing unit that performs a predetermined process on the booklet; a booklet holding unit that includes first and second holding members to hold the booklet and varies a gap distance between the first and second holding members depending on a state of processing the booklet while the sheet processing unit is performing the process on the booklet; and a pressing unit that presses and fixes the booklet while the processing unit is processing the booklet The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is an operation explanatory diagram of a sheet post-processing apparatus illustrating a state when a sheet bundle is carried in;

DETAILED DESCRIPTION OF THE PREFERRED EMBODIMENTS

Figure 1:
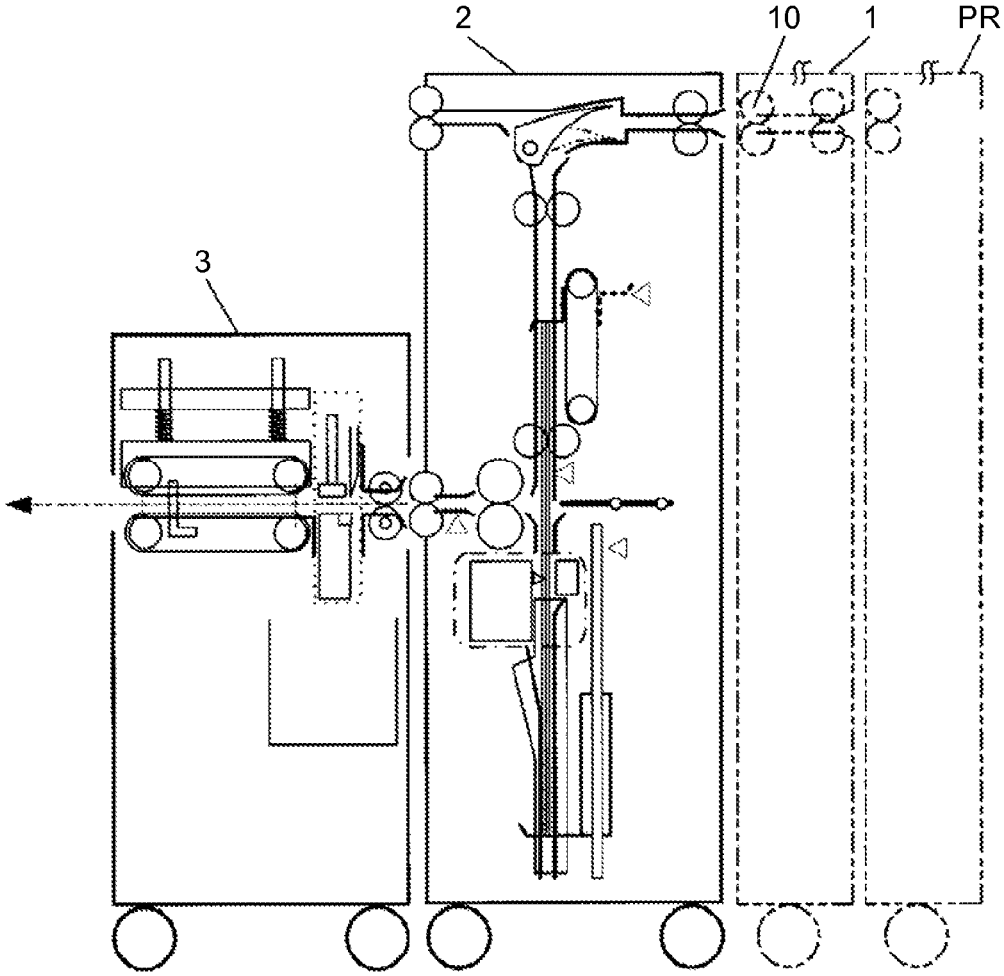
FIG. 1 is a diagram illustrating an image forming system including an image forming apparatus and a plurality of sheet processing apparatuses according to an embodiment.

In the present invention, a pair of guide units movable in the vertical direction are provided above and below the booklet. A distance between the pair of guide units can be relatively changed in a process of feeding a sheet. The sheet is conveyed, aligned, and fixed while the distance between the guide units is changed. A cutting process is executed after the sheets are fixed.

An embodiment of the present invention will be described below with reference to the accompanying drawings. Note that, in the description given below, the same parts will be given the same reference numerals, and duplicate explanations will be omitted as appropriate.

FIG. 1 is a diagram illustrating an image forming system including an image forming apparatus and a plurality of sheet processing apparatuses according to the embodiment. In this embodiment, first to third sheet post-processing apparatuses 1, 2, and 3 are connected in this order in subsequent stages of the image forming apparatus PR.

The first sheet post-processing apparatus 1 has a sheet bundle creation function including a stack unit that receives sheets from the image forming apparatus PR one by one, sequentially stacks and aligns the sheets, and creates a sheet bundle. The first sheet post-processing apparatus 1 discharges the sheet bundle from sheet bundle discharging rollers 10 to the second sheet post-processing apparatus in the subsequent stage. The second sheet post-processing apparatus 2 is a saddle-stitching bookbinding apparatus that receives the sheet bundle conveyed from the first sheet post-processing apparatus 1, and performs saddle stitching and middle folding on the sheet bundle (hereinafter, the second sheet post-processing apparatus will be also called a "saddle-stitching bookbinding apparatus").

The saddle-stitching bookbinding apparatus 2 discharges the bound booklet to the third sheet post-processing apparatus 3. The third sheet post-processing apparatus 3 is a cutter that cuts the fore edges of the sheets that have been conveyed (hereinafter, the third sheet post-processing apparatus will be also called a "cutter"). The booklet subjected to the cutting process in the cutter 3 is directly discharged out of the cutter, and placed on a discharge tray (not illustrated). Alternatively, if a sheet processing apparatus is further connected in the subsequent stage, the booklet is directly discharged to that sheet processing apparatus. The image forming apparatus PR forms a visible image on a sheet-like recording medium based on received image data or image data of a scanned image. For example, a copying machine, a printer, a facsimile apparatus, and a digital MFP provided with at least two functions of these devices correspond to the image forming apparatus PR.

Figure 2:
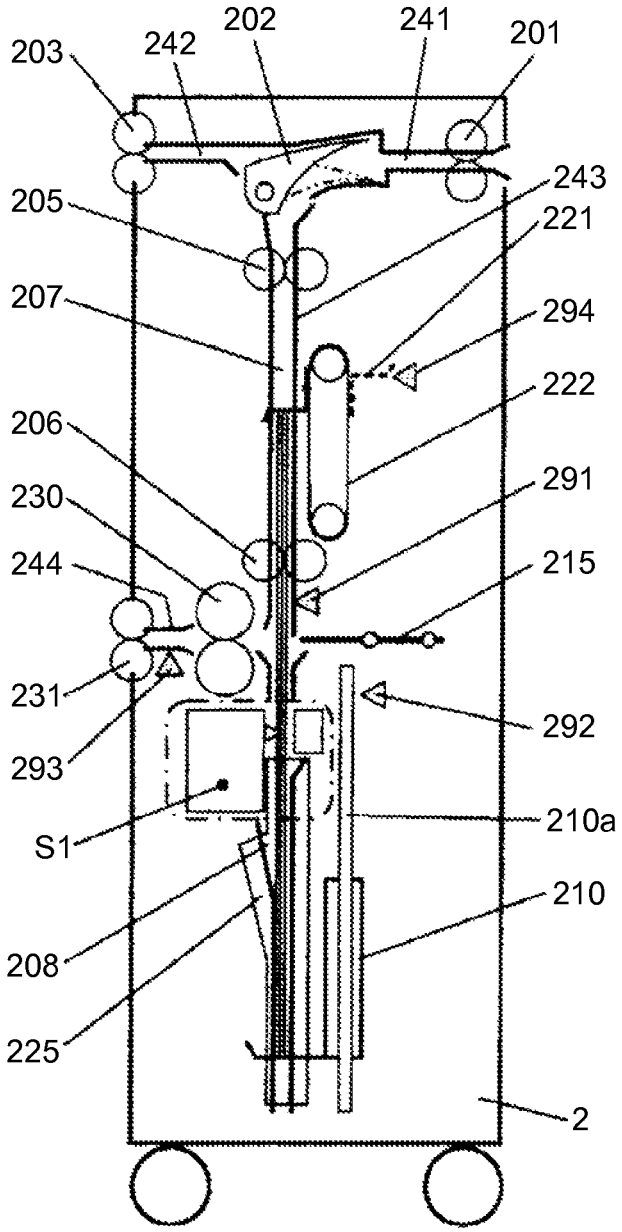
FIG. 2 is a diagram illustrating a detailed structure of a saddle-stitching apparatus 2 in FIG. 1.

FIG. 2 is a diagram illustrating a detailed structure of the saddle-stitching apparatus 2 in FIG. 1. In this diagram, the saddle-stitching apparatus 2 is provided with an entrance conveying path 241, a sheet-through conveying path 242, and a middle-folding conveying path 243. The uppermost stream portion in the sheet conveying direction of the entrance conveying path 241 is provided with entrance rollers 201, through which the aligned sheet bundle is carried in from the sheet bundle discharging rollers 10 of the first sheet post-processing apparatus 1. Note that, in the description given below, the upstream side in the sheet conveying direction will be simply called the upstream side, and the downstream side in the sheet conveying direction will be simply called the downstream side.

A bifurcating claw 202 is provided on the downstream side of the entrance rollers 201 in the entrance conveying path 241. The bifurcating claw 202 is placed in the horizontal direction in the diagram, and switches the conveying direction of the sheet bundle to the sheet-through conveying path 242 or the middle-folding conveying path 243. The sheet-through conveying path 242 is a conveying path that extends horizontally from the entrance conveying path 241 and guides the sheet bundle to a processing apparatus or a discharge tray (both not illustrated) in the subsequent stage. The sheet bundle is discharged to the subsequent stage by upper discharging rollers 203. The middle-folding conveying path 243 is a conveying path that extends vertically downward from the bifurcating claw 202 and along which saddle stitching and middle folding are performed on the sheet bundle.

The middle-folding conveying path 243 is provided with an upper bundle-conveying guide plate 207 that guides the sheet bundle above a folding plate 215 for middle folding and a lower bundle-conveying guide plate 208 that guides the sheet bundle below the folding plate 215. The upper bundle-conveying guide plate 207 is provided, from the top, with upper bundle-conveying rollers 205, a trailing edge tapping claw 221, and lower bundle-conveying rollers 206. The trailing edge tapping claw 221 is mounted in a standing manner on a trailing edge tapping claw drive belt 222 driven by a driving motor (not illustrated). The trailing edge tapping claw 221 aligns the sheet bundle by tapping (pressing) the trailing edge of the sheet bundle to the side of a movable fence (to be described later) by using a reciprocating rotational motion of the drive belt 222. When the sheet bundle is carried in and when the sheet bundle is raised for middle folding, the trailing edge tapping claw 221 is retracted from the middle-folding conveying path 243 on the upper bundle-conveying guide plate 207 (to a position indicated by a dashed line in FIG. 2).

A reference numeral 294 represents a trailing edge tapping claw home position (HP) sensor for detecting the home position of the trailing edge tapping claw 221. The trailing edge tapping claw HP sensor detects, as the home position, the position indicated by the dashed line in FIG. 2 where the trailing edge tapping claw 221 is retracted from the middle-folding conveying path 243. The trailing edge tapping claw 221 is controlled with reference to the home position.

The lower bundle-conveying guide plate 208 is provided, from the top, with a saddle-stitching stapler S1, a pair of saddle-stitching jogger fences 225, and a movable fence 210. The lower bundle-conveying guide plate 208 is a guide plate that receives the sheet bundle fed through the upper bundle-conveying guide plate 207, with the pair of saddle-stitching jogger fences 225 arranged in the width direction. The lower bundle-conveying guide plate 208 is provided therebelow with the movable fence 210 that abuts (supports) the leading edge of the sheet bundle in a vertically movable manner.

The saddle-stitching stapler S1 is a stapler that staples a central portion of the sheet bundle. The movable fence 210 moves in the vertical direction while supporting the leading edge of the sheet bundle, and positions the center position of the sheet bundle in a position facing the saddle-stitching stapler S1, where a stapling process, that is, the saddle stitching is performed. The movable fence 210 is supported by a movable fence drive mechanism 210*a*, and is movable from the position of a movable fence HP sensor 292 illustrated above in the diagram to the lowest position. The movable range of the movable fence on which the leading edge of the sheet bundle abuts, ensures a sufficient stroke to process the sheet bundle having a size varying from a minimum size to a maximum size that can be handled by the saddle-stitching apparatus 2. Note that, for example, a rack and pinion mechanism is used as the movable fence drive mechanism 210*a*.

The folding plate 215, a pair of folding rollers 230, a discharged paper conveying path 244, and lower discharging rollers 231 are provided between the upper and the lower bundle-conveying guide plates 207 and 208, that is, near a central portion of the middle-folding conveying path 243. The folding plate 215 can make a reciprocating motion in the horizontal direction in the diagram. A nip of the pair of folding rollers 230 is located in the direction of motion during folding operation, and the discharged paper conveying path 244 is placed in the extension beyond the nip. The lower discharging rollers 231 are provided at the lowermost stream of the discharged paper conveying path 244, and discharge the folded sheet bundle to the subsequent stage.

A sheet bundle detecting sensor 291 is provided on the lower end side of the upper bundle-conveying guide plate 207, and detects the leading edge of the sheet bundle that is carried into the middle-folding conveying path 243 and passes through a middle folding position. A folded portion passage sensor 293 is provided on the discharged paper conveying path 244, and detects the leading edge of the middle-folded sheet bundle, thereby recognizing the passage of the sheet bundle.

In the saddle-stitching apparatus 2 structured as schematically illustrated in FIG. 2, a saddle-stitching and middle-folding operation is performed as illustrated in operation explanatory diagrams, FIGS. 3 to 7. That is, when the saddle-stitching and middle-folding operation is selected from an operation panel PN (refer to FIG. 15) of the image forming apparatus PR, the sheet bundle for which the saddle-stitching and middle-folding operation is selected is guided to the side of the middle-folding conveying path 243 by a counterclockwise biasing operation of the bifurcating claw 202. The bifurcating claw 202 is driven by a solenoid. The bifurcating claw 202 may be driven by a motor instead of the solenoid.

Figure 3:
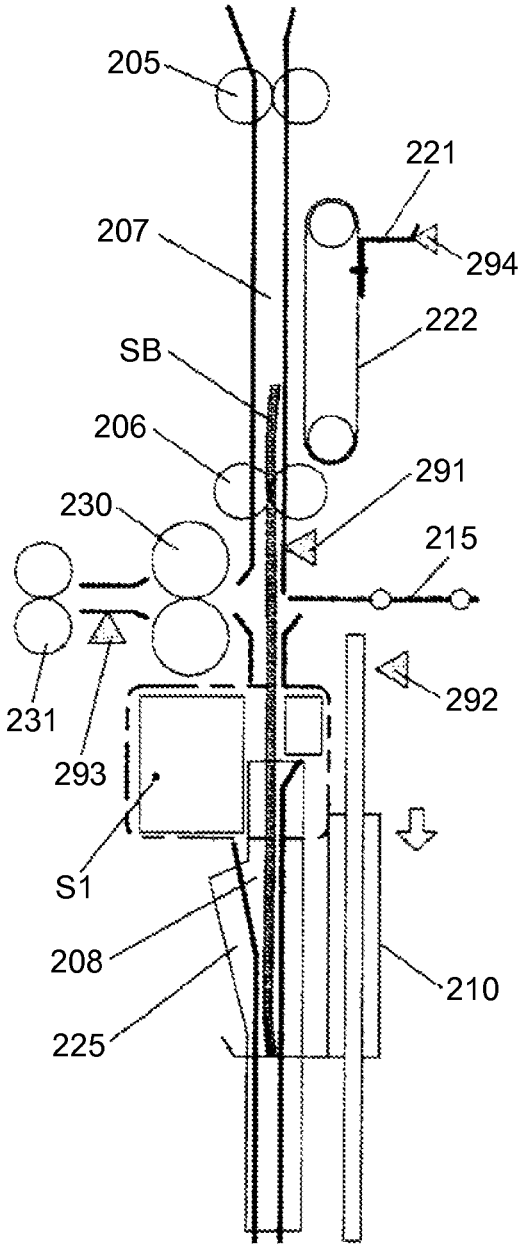

The sheet bundle SB fed into the middle-folding conveying path 243 is conveyed downward through the middle-folding conveying path 243 by the entrance rollers 201 and the upper bundle-conveying rollers 205, and, after confirmation of passage thereof by the sheet bundle detecting sensor 291, is conveyed by the lower bundle-conveying rollers 206 to a position where the leading edge of the sheet bundle SB abuts on the movable fence 210, as illustrated in FIG. 3. At that time, the movable fence 210 stands by in a stopping position that differs depending on sheet size information, that is, size information in the conveying direction of each sheet bundle SB in this case, received from the image forming apparatus PR. At this time, as illustrated in FIG. 3, the lower bundle-conveying rollers 206 sandwich the sheet bundle SB in a nip thereof, and the trailing edge tapping claw 221 stands by in the home position.

Figure 4:
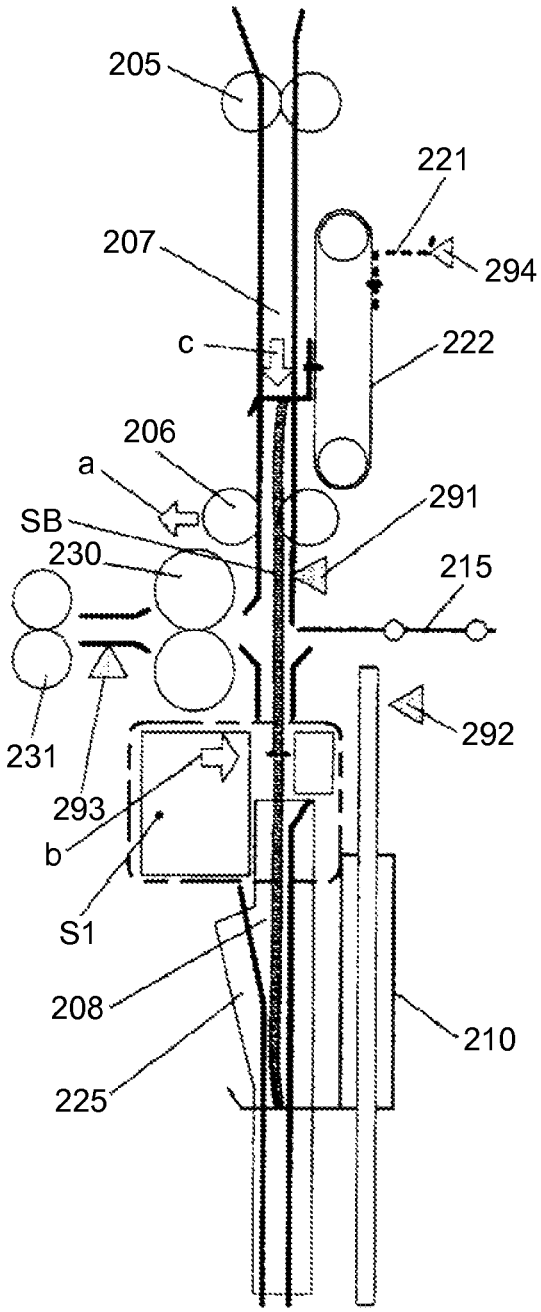
FIG. 4 is an operation explanatory diagram of the sheet post-processing apparatus illustrating a state when the sheet bundle is saddle-stitched.

In this state, as illustrated in FIG. 4, when the sandwiching pressure of the lower bundle-conveying rollers 206 is released (in the direction of arrow a), and the sheet bundle is stacked with the leading edge thereof abutting on the movable fence 210 and the trailing edge thereof being freed, the trailing edge tapping claw 221 is driven to tap the trailing edge of the sheet bundle SB, thus performing a final alignment in the conveying direction (in the direction of arrow c).

Next, the saddle-stitching jogger fences 225 perform an aligning operation in the width direction (direction perpendicular to the sheet conveying direction), while the movable fence 210 and the trailing edge tapping claw 221 perform an aligning operation in the conveying direction, thus completing the aligning operations in the width direction and the conveying direction of the sheet bundle SB, respectively. In these operations, the alignment is performed by adjusting the pressing amount of the trailing edge tapping claw 221 and the saddle-stitching jogger fences 225 to optimal values according to the information on the sheet size, the number of sheets in the bundle, and the sheet bundle thickness.

If the bundle is thick, the space in the conveying path is reduced, and it is likely that the alignment operation cannot be performed completely in one time. Accordingly, in such a case, the number of times of the aligning operations is increased, whereby a better alignment can be achieved. Moreover, as the number of sheets accumulates, the time for sequentially stacking the sheets on the upstream side increases, and thus, the time for receiving the next sheet bundle SB becomes longer. As a result, systematically, there is no time loss by increasing the number of times of the aligning operations. Therefore, a good alignment can be achieved efficiently. Consequently, the number of times of the aligning operations can also be controlled corresponding to the processing time on the upstream side.

The standby position of the movable fence 210 is normally set in a position in which the saddle-stitching position of the sheet bundle SB faces the stapling position of the saddle-stitching stapler S1. This is because, if the aligning operation is performed in this position, the stapling process can be performed in the stacked position without having to move the movable fence 210 to the saddle-stitching position of the sheet bundle SB. In this standby position, a stitcher of the saddle-stitching stapler S1 is then driven in the direction of arrow b to the central portion of the sheet bundle SB, and the stapling process is performed between the stitcher and a clincher, thus saddle-stitching the sheet bundle SB.

The movable fence 210 is positioned by pulse control from the movable fence HP sensor 292, and the trailing edge tapping claw 221 is positioned by pulse control from the trailing edge tapping claw HP sensor 294. The position control processes of the movable fence 210 and the trailing edge tapping claw 221 are executed by a CPU 251 of a control circuit 250 in the sheet post-processing apparatus (refer to FIG. 15).

Figure 5:
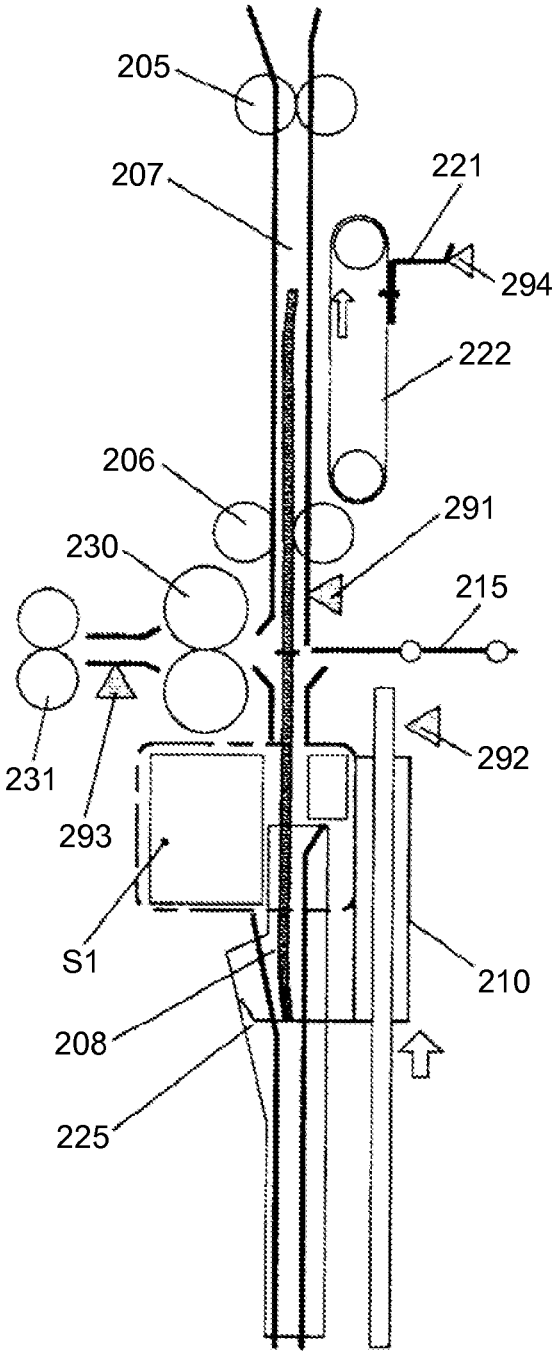
FIG. 5 is an operation explanatory diagram of the sheet post-processing apparatus illustrating a state when the sheet bundle has completed a movement to a middle folding position.

The sheet bundle SB saddle-stitched in the state illustrated in FIG. 4 is transferred, as illustrated in FIG. 5, along with an upward movement of the movable fence 210 in the state in which the pressure of the lower bundle-conveying rollers 206 is released until the saddle-stitching position (center position of the sheet bundle SB in the conveying direction) that faces the folding plate 215. This position is also controlled with reference to a detecting position of the movable fence HP sensor 292.

Figure 6:
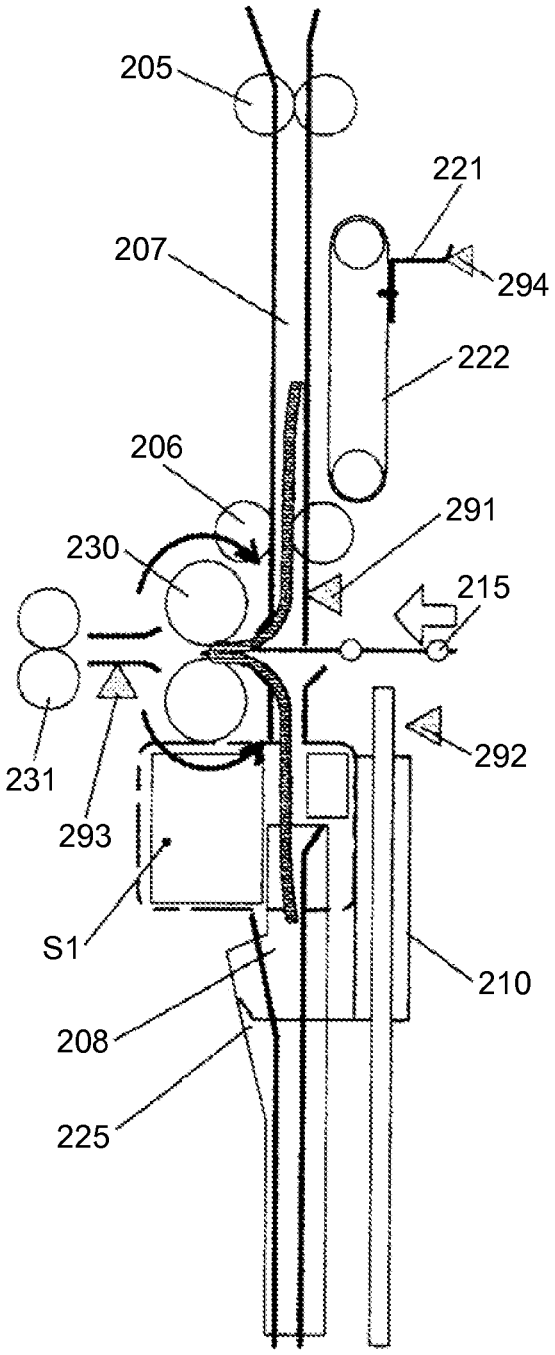
FIG. 6 is an operation explanatory diagram of the sheet post-processing apparatus illustrating a state when the sheet bundle is being middle-folded.

When the sheet bundle SB reaches the position illustrated in FIG. 5, the folding plate 215 moves toward the nip of the pair of folding rollers 230 as illustrated in FIG. 6, then abuts on the sheet bundle SB near a staple portion of the stapled sheet bundle SB from a substantially perpendicular direction, and then pushes the sheet bundle SB out toward the nip side. The sheet bundle SB is pushed by the folding plate 215, guided to the nip of the pair of folding rollers 230, and wedged into the nip of the pair of folding rollers 230 that are already rotating. The pair of folding rollers 230 presses and conveys the sheet bundle SB wedged into the nip. By this pressure conveying operation, the sheet bundle SB is folded in the middle, and a simply bound booklet BT is formed. FIG. 6 illustrates a state when the leading edge of the folded portion of the sheet bundle SB is sandwiched and pressed in the nip of the pair of folding rollers 230.

Figure 7:
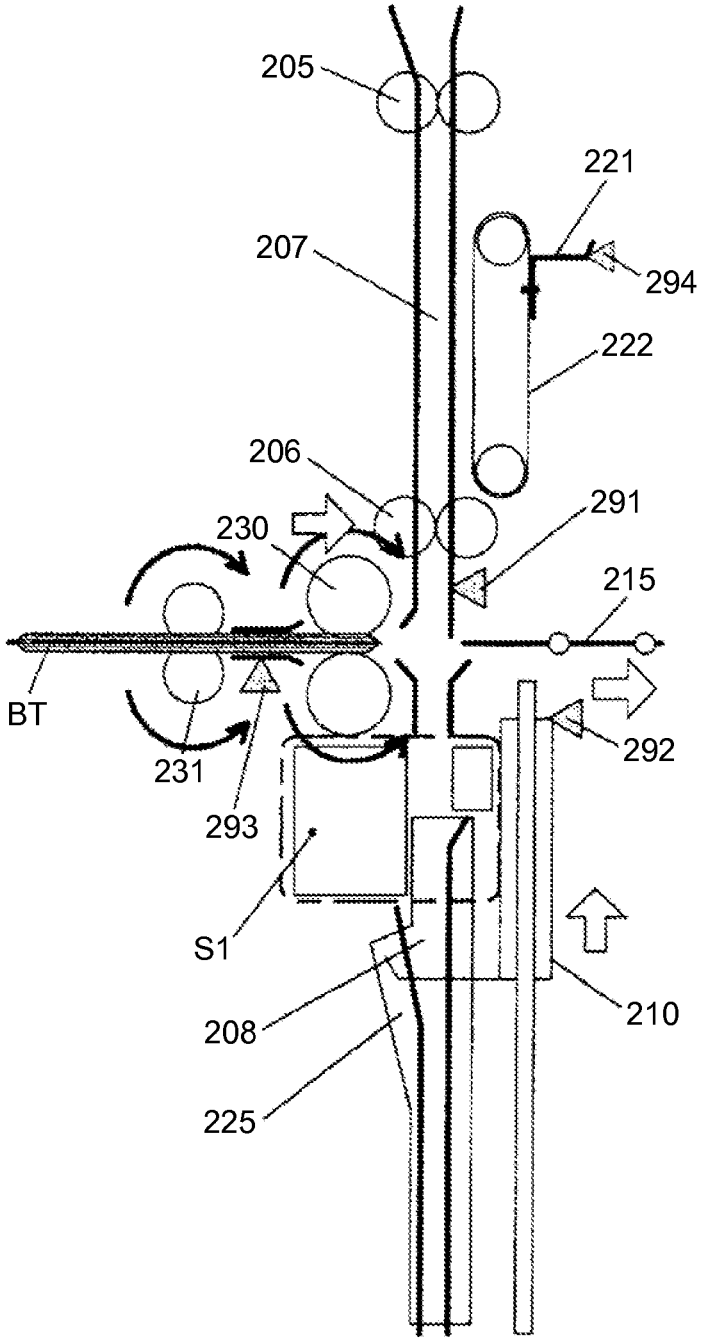
FIG. 7 is an operation explanatory diagram of the sheet post-processing apparatus illustrating a state when the sheet bundle is discharged after having been middle-folded.

The sheet bundle SB doubled in the middle in the state illustrated in FIG. 6 is conveyed, as illustrated in FIG. 7, as the booklet BT by the pair of folding rollers 230, then sandwiched by the lower discharging rollers 231, and then discharged to the subsequent stage. At this time, when the trailing edge of the booklet BT is detected by the folded portion passage sensor 293, the folding plate 215 and the movable fence 210 return to their respective home positions, and the lower bundle-conveying rollers 206 resume the pressing state, thus preparing for the next sheet bundle SB to be carried in. If the next job is to be performed on the same size and the same number of sheets, the movable fence 210 may move again to the position illustrated in FIG. 3 and stand by. Note that these operations are also controlled by the CPU 251 of the control circuit 250.

Figure 8:
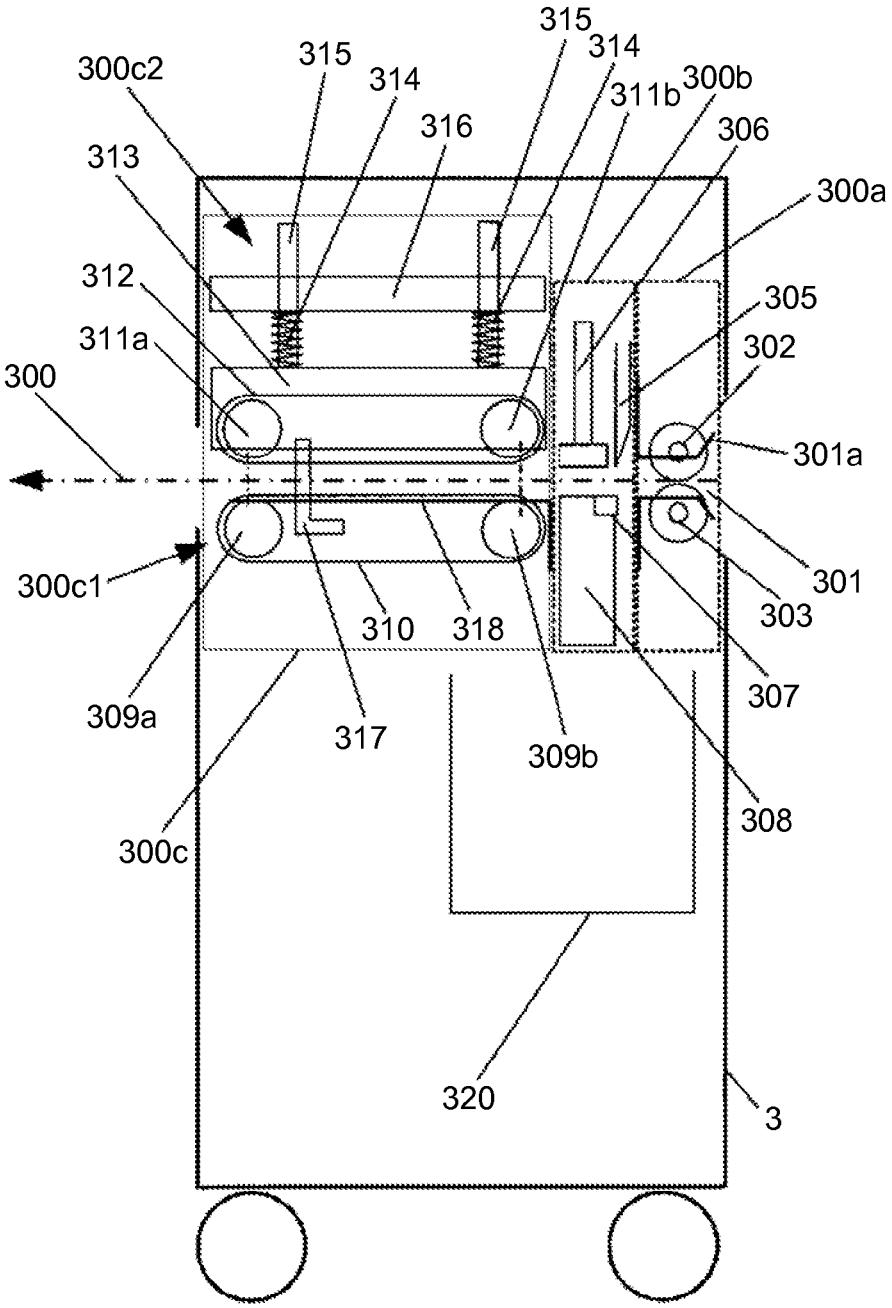
FIG. 8 is a diagram illustrating a detailed structure of a cutter serving as one of the sheet processing apparatuses in FIG. 1.

FIG. 8 is a diagram illustrating a detailed structure of the cutter 3.

In FIG. 8, the cutter 3 is provided, from the upstream side along a conveying path 300 of the booklet (arrow indicates the conveying center), with a conveying unit 300*a*, a cutting unit 300*b*, and an aligning unit 300*c*.

Figure 11:
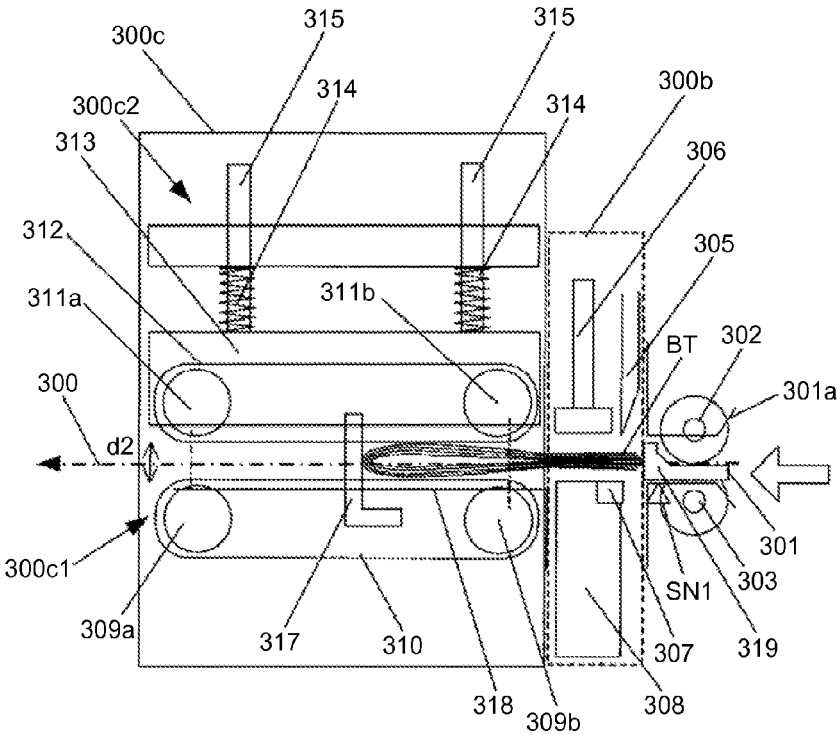
FIG. 11 is an operation explanatory diagram illustrating a cutting operation of the cutter, presented to illustrate an aligning operation to align the conveying direction of the booklet.

The conveying unit 300*a* corresponds to an entrance of the cutter, and is provided with an entrance guide plate 301*a*, a pair of upper and lower conveying rollers 302 and 303, and a jogger 319 for aligning the booklet BT in the conveying direction (on the fore-edge side) (refer to FIG. 11). The conveying unit 300*a* receives the middle-folded and saddle-stitched booklet BT from the lower discharging rollers 231 of the saddle-stitching apparatus 2 through the entrance guide plate 301*a* of a booklet receiving port 301. Note that, instead of the pair of conveying rollers 302 and 303, it is possible to use a pair of conveying belts that are arranged above and below to sandwich the booklet BT at a predetermined pressure in a manner capable of conveying the booklet BT.

The cutting unit 300*b* is provided with cutting blades and a pressing unit with the conveying path 300 interposed therebetween. The cutting blades, an upper cutting blade 305 and a lower cutting blade 307 form a pair, and are arranged above and below the conveying path 300 opposing each other. The upper cutting blade 305 is movable whereas the lower cutting blade 307 is fixed. The upper cutting blade 305 on the movable side moves down toward the booklet BT located on the lower cutting blade 307 on the fixed side, and cuts the fore-edge side of the booklet BT between the two blades. In addition, a scrap receiver 320 for receiving scraps of the cut booklet is provided below the cutting unit 300*b*.

The pressing unit is composed of a pressing member 306 on the movable side and a base 308 serving as the fixed side, the former being arranged above and the latter being arranged below the conveying path 300 with the conveying path 300 interposed therebetween. The lower cutting blade 307 is fixed to an edge on the uppermost stream side in the conveying direction of the base 308. The fixing position is set in a position as such that the cutting can be performed by a cutting edge of the upper cutting blade 305 and a cutting edge of the lower cutting blade 307. The upper cutting blade 305 is driven by a drive mechanism (not illustrated) downward to a position beyond the lower cutting blade 307, and upward to a position where the upper cutting blade 305 does not obstruct the receiving of the booklet BT. The upper standby position is the initial position.

The pressing member 306 located above the base 308 is driven by a drive mechanism (not illustrated) in the vertical direction, and has a function to hold the booklet BT by pressing it to the side of the base 308 near the upper cutting blade 305 when the upper cutting blade 305 moves down to cut the booklet BT. The upper cutting blade 305 and the pressing member 306 are driven by the respective drive mechanisms (not illustrated) each using a motor and a speed reduction mechanism connected to the motor. However, the drive mechanisms can be each structured to perform the driving in the vertical direction using hydraulic pressure instead of the motor and the speed reduction mechanism.

The aligning unit 300*c* includes a lower unit 300*c*1 and an upper unit 300*c*2 with the conveying path 300 interposed therebetween, the lower unit 300*c*1 being located below and the upper unit 300*c*2 being located above the conveying path 300. The lower unit 300*c*1 is provided with a first conveying belt 310 on the fixed side, a positioning stopper 317, and a guide plate 318. The first conveying belt 310 is wound between a driving pulley 309*a* and a driven pulley 309*b*. The upper surface of the first conveying belt 310 is located in the same plane as the upper surface of the base 308, and serves also as a reference plane of conveyance of the booklet BT.

The upper unit 300*c*2 includes a second conveying belt 312, a driving pulley 311*a*, a driven pulley 311*b*, a support member 313, guide shafts 315, a pressing plate 316, and compression springs 314. The second conveying belt 312 is wound between the driving pulley 311*a* and the driven pulley 311*b*. The support member 313 supports the second conveying belt 312, the driving pulley 311*a*, and the driven pulley 311*b* in an integrated manner. The guide shafts 315 are mounted on the upper surface of the support member 313, and equipped with the pressing plate 316 in a vertically movable manner. The guide shafts 315 between the support member 313 and the pressing plate 316 are also equipped with the compression springs 314 that provide elastic force in a direction in which the support member 313 and the pressing plate 316 move away from each other. The second conveying belt 312, the driving pulley 311*a*, the driven pulley 311*b*, the support member 313, the guide shafts 315, and the pressing plate 316 are vertically movable in an integrated manner as the upper unit 300*c*2. Thus, a distance between the upper surface of the first conveying belt 310 and the lower surface of the second conveying belt 312 can be relatively changed.

With this structure, when the first and the second conveying belts 310 and 312 sandwich the booklet BT, the distance therebetween can be reduced. At that time, because a distance between the pressing plate 316 and the support member 313 can also be changed, when the pressing plate 316 is moved further down after the second conveying belt 312 presses the upper surface of the booklet BT, the compression springs 314 are further compressed, and thus, holding force, or pressing force, on the booklet BT can be increased. A drive mechanism (not illustrated) for driving the upper unit 300*c*2 in the vertical direction includes a motor, a power transmission mechanism, and a guide in the vertical direction that directly move the pressing plate 316 in the vertical direction. When the pressing plate 316 is moved in the vertical direction with the distance between the pressing plate 316 and the support member 313 kept at an initial value, the entire upper unit 300*c*2 moves in the vertical direction. In the state in which the second conveying belt 312 is in contact with the upper surface of the booklet BT, when the pressing plate 316 is moved further downward, the compression springs 314 are compressed, and thus, a pressure by the compression springs 314 is produced by that much. This pressure serves as the holding force, or the pressing force, on the booklet BT.

The first conveying belt 310, together with the second conveying belt 312, has a function to convey the booklet BT, and also has a function as a guide during alignment of the sheets. Because the first and the second conveying belts 310 and 312 have the additional function as a guide during the alignment of the booklet, materials used for surfaces coming in contact with the booklet BT have each a low coefficient of friction against the sheet, and moreover, the coefficients of friction of the two conveying belts 310 and 312 are set to be almost equal to each other. Thereby, when the booklet is pressed, the force applied to the upper side and the lower side of the booklet are low and almost equal to each other. Therefore, misalignment can be reduced when the booklet is pressed.

In this embodiment, the first and the second conveying belts 310 and 312 have also a guiding function as guide units. However, it is also possible to provide the guide plate 318 along the first conveying belt 310 on the lower side as illustrated in FIG. 8, to give the guide plate 318 a function as a guide, and to use another conveying unit such as conveying rollers for the function to convey the booklet BT. In that case, the upper surface of the guide plate 318 is located in the same plane as the upper surface of the base 308, and serves also as the reference plane of conveyance of the booklet BT. It is also possible to structure the second conveying belt 312 on the upper side so as to press the booklet BT to the side of the guide plate 318.

In addition, in this embodiment, the first conveying belt 310 on the lower side is fixed, and the second conveying belt 312 on the upper side performs the up and down operations. However, it is also possible to structure the second conveying belt 312 on the upper side so as to serve as a fixed side and the first conveying belt 310 on the lower side so as to serve as a moving side, or to structure both of the first and the second conveying belts 310 and 312 so as to move.

Furthermore, the positioning stopper 317 installed in the aligning unit 300*c* is provided with a moving mechanism (not illustrated) that can move the stopper in the booklet conveying direction. Based on the information such as the size and the cutting amount of the booklet BT, the moving mechanism moves the stopper to a predetermined position, and the booklet BT is positioned by being abutted on the spine side thereof by the stopper. The moving mechanism includes a motor and a transmission mechanism of the driving force of the motor.

Figure 15:
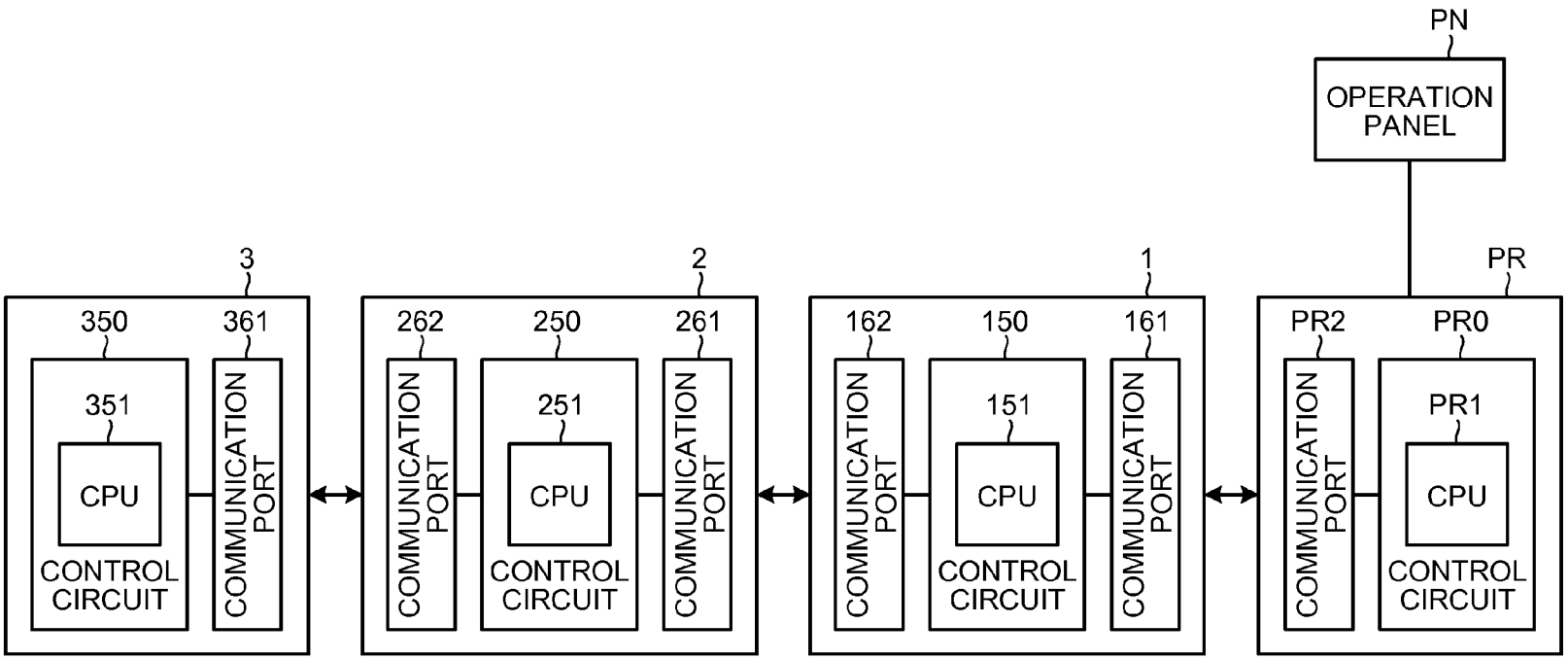
FIG. 15 is a block diagram illustrating a control structure of the image forming system in the embodiment of the present invention.
Figure 16:
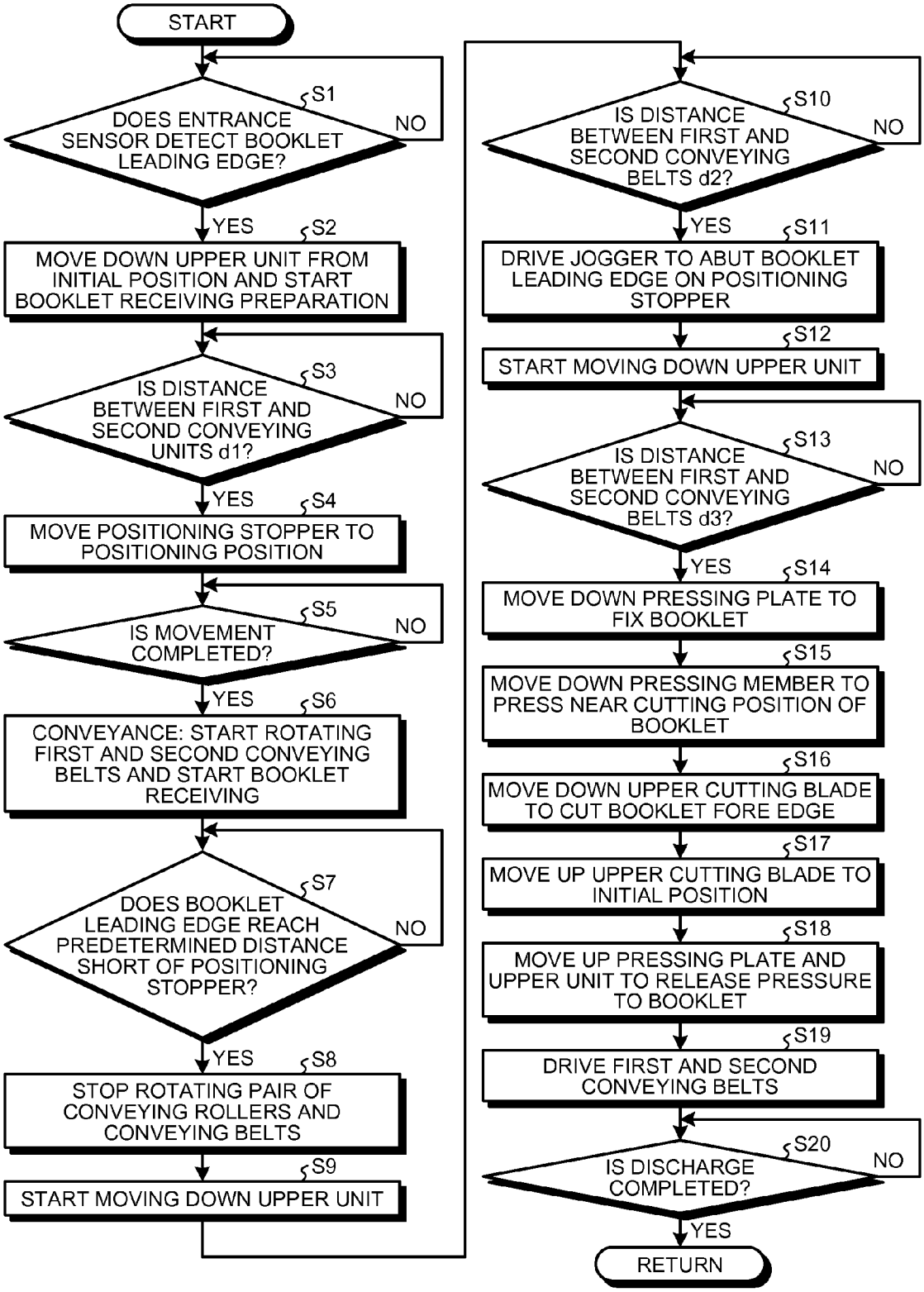
FIG. 16 is a flow chart illustrating a processing procedure of the pressing process and the cutting process executed in the cutter.

FIGS. 9 to 14 are operation explanatory diagrams each illustrating a cutting operation of the cutter in this embodiment; FIG. 15 is a block diagram illustrating a control structure of the image forming system in this embodiment; and FIG. 16 is a flow chart illustrating a processing procedure of the pressing process and the cutting process illustrated in FIGS. 9 to 14.

In the image forming system according to this embodiment illustrated in FIG. 15, the first sheet post-processing apparatus 1, the second sheet post-processing apparatus (middle-folding and saddle-stitching apparatus) 2, and the third sheet post-processing apparatus (cutter) 3 are connected in the subsequent stages of the image forming apparatus PR, as illustrated in FIG. 1. The image forming apparatus PR and the sheet post-processing apparatuses 1, 2, and 3 are equipped with control circuits PR0, 150, 250, and 350, respectively, that incorporate microcomputers having components such as central processing units (CPUs) PR1, 151, 251, and 351, respectively, read-only memories (ROMs), random access memories (RAMs), and I/O interfaces, and are connected in series in terms of control via communication ports PR2, 161, 162, 261, 262, and 361. Moreover, the CPUs 151, 251, and 351 of the control circuits 150, 250, and 350 in the first to third sheet post-processing apparatuses 1, 2, and 3 are placed under the control of the CPU PR1 as a main CPU of the control circuit PR0 in the image forming apparatus PR, and serve as sub CPUs. In addition, an operation panel PN serving as a man-machine interface is connected to the image forming apparatus PR, thereby enabling input from an operator and notification to the operator via a display unit.

That is, each part of each of the sheet post-processing apparatuses 1, 2, and 3 is controlled by each of the CPUs 151, 251, and 351 mounted in each of the apparatuses, and the CPU PR1 of the image forming apparatus PR controls the entire system. The apparatuses perform control in the following manner. The CPUs 151, 251, and 351 of the respective apparatuses read program codes stored in the ROM of the corresponding apparatus, and perform control based on a program defined by the program codes while using the RAM as a work area and a data buffer. The CPU 151 of the first sheet post-processing apparatus 1 can mutually communicate with the CPU PR1 of the image forming apparatus PR from the communication port 161 via the communication port PR2 of the image forming apparatus PR. In addition, the CPUs 251 and 351 of the second and the third sheet post-processing apparatuses 2 and 3 can mutually communicate with the CPU PR1 of the image forming apparatus PR via the communication ports and the CPUs in the previous stages. With such a structure, information required for control by the CPU PR1 of the image forming apparatus PR is sent from the CPUs 351, 251, and 151 of the third sheet post-processing apparatus 3, the second sheet post-processing apparatus 2, and the first sheet post-processing apparatus 1 to the image forming apparatus PR side, and control signals from the CPU PR1 of the image forming apparatus PR is sent to the CPU 151 of the first sheet post-processing apparatus 1, the CPU 251 of the second sheet post-processing apparatus 2, and the CPU 351 of the third sheet post-processing apparatus 3.

In this way, the booklet information is sent from the CPU PR1 of the image forming apparatus PR to the CPU 351 of the cutter 3 serving as the third sheet post-processing apparatus 3. The CPU 351 of the cutter 3 performs the pressing process and the cutting process based on the received booklet information.

With reference to the operation explanatory diagrams of FIGS. 9 to 14 and the flow chart of FIG. 16, operations and processes in the cutter 3 will be described below. In this embodiment, the CPU 351 of the cutter 3 executes the processing procedure illustrated in FIG. 16. Note that, because this embodiment is structured as an image forming system, the processes can be structured to be controlled by the CPU PR1 of the image forming apparatus PR.

Figure 9:
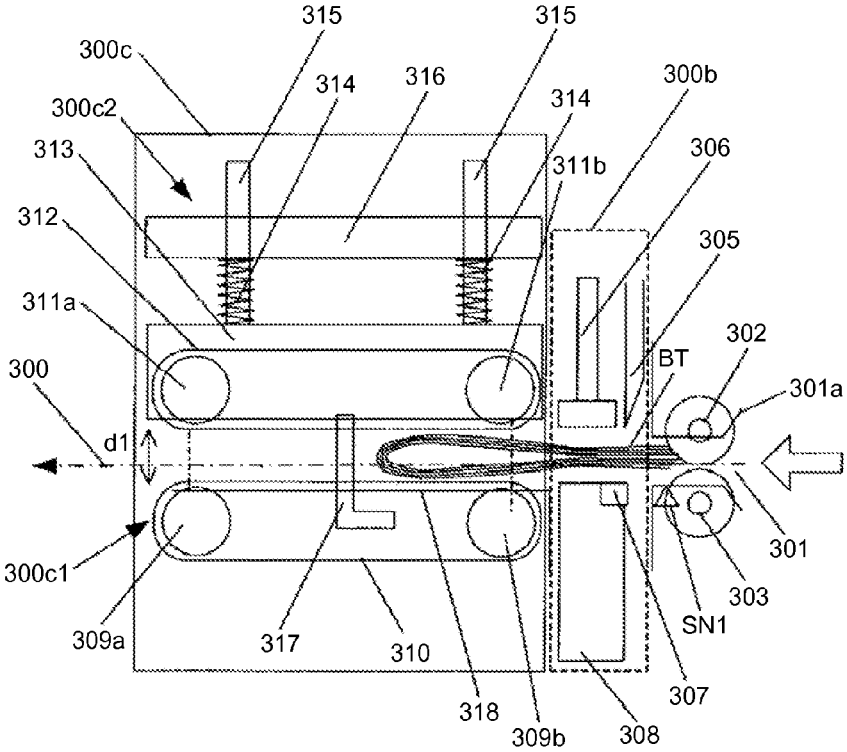
FIG. 9 is an operation explanatory diagram illustrating a cutting operation of the cutter, presented to illustrate a state immediately after the booklet is carried into the cutter.

FIG. 9 is a diagram illustrating a state immediately after the booklet BT is carried into the cutter 3. In the diagram, the booklet BT is carried into the cutter 3 through the entrance guide plate 301*a*. In that process, when a detection signal of the booklet leading edge is detected by an entrance sensor SN1 provided on the immediately downstream side of the booklet receiving port 301, or a detection signal of the folded portion leading edge of the sheet bundle SB is detected by the folded portion passage sensor 293 of the saddle-stitching apparatus 2 (Step S1), each part of the cutter 3 starts a booklet receiving preparatory operation (Step S2). The booklet receiving preparatory operation is an operation of moving down the upper unit 300*c*2 from an initial position thereof. By the booklet receiving preparatory operation, the upper unit 300*c*2 moves to a position in which the distance between the lower surface of the second conveying belt 312 and the upper surface of the first conveying belt 310 is a first distance d1 when the sheets are carried in (Step S3). As will be described later, the CPU 351 determines the first distance d1 by referring to a database stored in a memory (not illustrated) in the control circuit 350 of the cutter 3 based on the booklet information such as the sheet thickness, the sheet size, the number of bound sheets, and special paper. The distance d1 is a distance that can provide frictional force by which the first and the second conveying belts 310 and 312 can convey the booklet BT after being carried into the cutter 3 by the pair of conveying rollers 302 and 303. That is, the distance d1 is sufficient to be a distance at which the booklet BT can be conveyed.

The positioning stopper 317 moves to a position in which the sheets are positioned based on the information such as the size and the cutting amount of the booklet (Step S4). When the movement is completed (Yes at Step S5), the pair of conveying rollers 302 and 303 and the first and the second conveying belts 310 and 312 start rotating and start receiving the booklet BT (Step S6). In order to match the phases between the first and the second conveying belts 310 and 312, the drives of the driving pulleys 309*a* and 311*a* are coupled. In the state as described above, at the time when a predetermined time has passed from the time when the entrance sensor SN1 has detected the leading edge of the spine (folded portion) of the booklet BT carried into the cutter 3 (Yes at Step S7), the first and the second conveying belts 310 and 312 stop rotating, and the leading edge (leading edge of folded portion or spine) of the booklet BT stops at a predetermined distance short of the positioning stopper 317 (Step S8).

Figure 10:
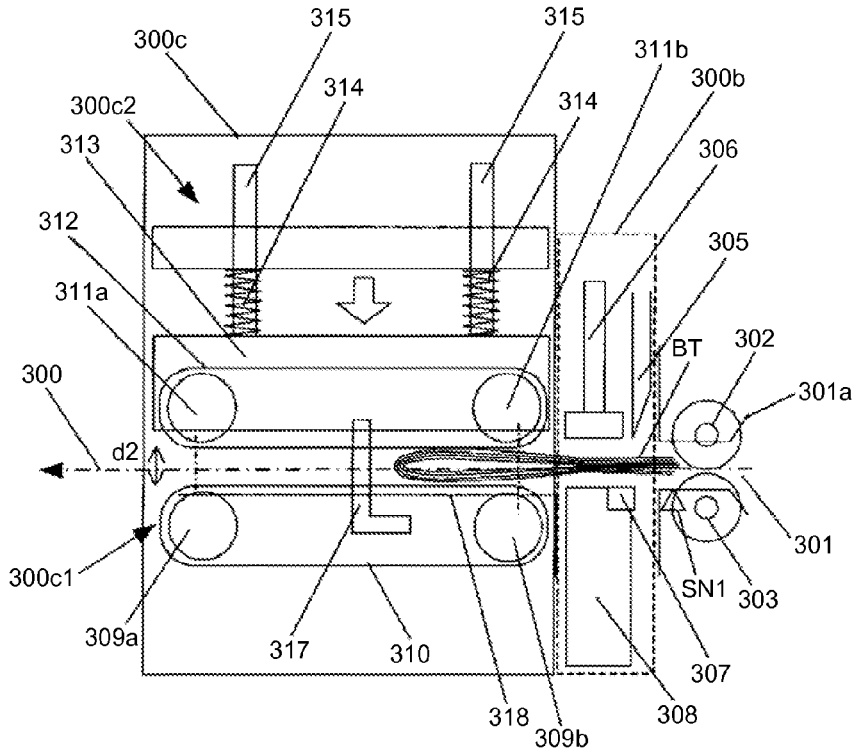
FIG. 10 is an operation explanatory diagram illustrating a cutting operation of the cutter, presented to illustrate an operation of pressing the booklet stopped after being carried in down to a certain thickness.

FIG. 10 is an operation explanatory diagram illustrating an operation of pressing the stopped booklet down to a certain thickness. After the booklet BT has stopped in the state of FIG. 9, the upper unit 300*c*2 moves down to a position in which the distance between the upper surface of the first conveying belt 310 and the lower surface of the second conveying belt 312 is a second distance d2 (Steps S9 and S10). By this operation, the bulky and thick booklet BT is pressed down to a certain height. In the same manner as the first distance d1, the second distance d2 is also determined as an aligning distance corresponding to the booklet information such as the sheet thickness, the sheet size, the number of bound sheets, and special paper. In this state, no change has occurred except that the position of the support member 313 has been changed to an aligning position.

FIG. 11 is an operation explanatory diagram illustrating an aligning operation to align the conveying direction of the booklet. In the state of FIG. 10, the booklet BT is pushed into an interval having the second distance d2, and then, while maintaining the distance at the second distance d2, the jogger 319 is driven. The jogger 319 pushes the fore-edge side of the booklet BT toward the positioning stopper 317, and abuts the spine side (leading edge in the conveying direction) of the booklet BT against the positioning stopper 317 (Step S11). Thereby, the booklet BT is positioned in the conveying direction. Therefore, the distance d2 is a distance at which the booklet BT can be pressed and moved to the side of the positioning stopper 317 by the jogger 319 without the booklet BT being subject to warp or distortion, that is, a distance enabling a reduction of height of the sheets and alignment processing.

As a method for abutting the booklet BT against the positioning stopper 317, it is also possible to employ a method in which the booklet BT is moved by the first and the second conveying belts 310 and 312. However, if the conveying force of the first and the second conveying belts 310 and 312 is large, turning up of a surface sheet of the booklet BT can occur. In that case, the conveying force needs to be set so that the first and the second conveying belts 310 and 312 do not cause any turning up in the booklet BT. In this embodiment, the jogger 319 is used in order to avoid such turning up from occurring.

Figure 12:
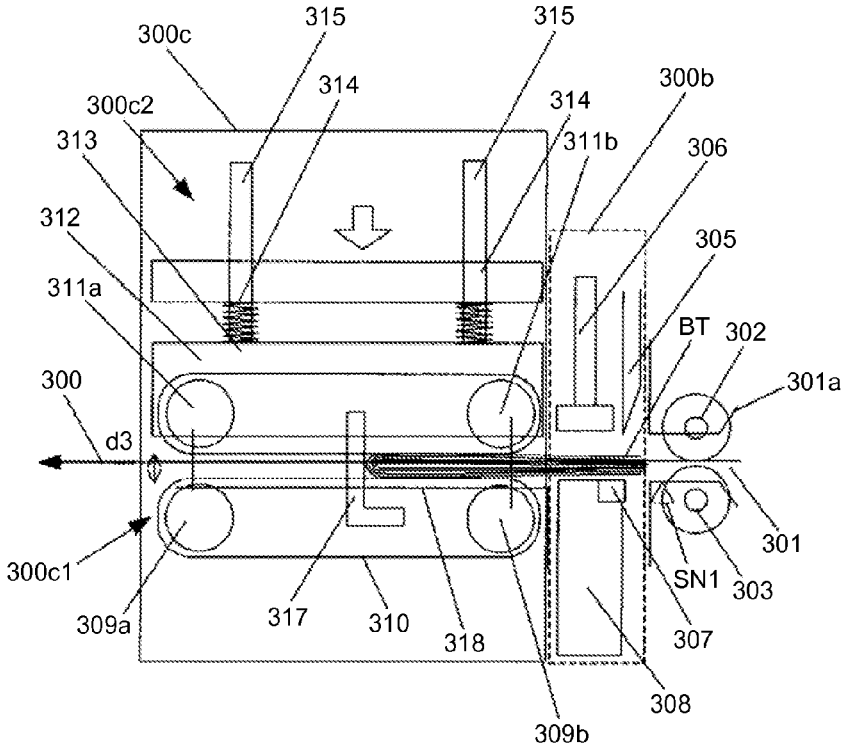
FIG. 12 is an operation explanatory diagram illustrating a cutting operation of the cutter, presented to illustrate an operation when the booklet is pressed and fixed.

FIG. 12 is an operation explanatory diagram illustrating an operation when the booklet is pressed and fixed. When the booklet BT has been positioned by the jogger 319 between the positioning stopper 317 and the jogger 319, the upper unit 300*c*2 is further moved down to a position at a third distance d3 (Steps S12 and S13). By this operation, the booklet BT is pressed to the side of the lower unit 300*c*1 and fixed between the first and the second conveying belts 310 and 312 (Step S14).

In that operation, after the first conveying belt 310 has come in contact with the upper surface of the booklet BT, the pressing plate 316 is further moved down. Thereby, the elastic force of the compression springs 314 is applied as a pressure to the booklet BT while the booklet BT is held at a minimum thickness. Accordingly, the pressure applied to the booklet BT can be controlled by changing or setting the amount of downward movement of the pressing plate 316. The amount of downward movement of the upper unit 300*c*2 (gap distance between the first and the second conveying belts 310 and 312) and the amount of downward movement of the pressing plate 316 are determined corresponding to the booklet information such as the sheet thickness, the sheet size, the number of bound sheets, and the paper type (such as special paper). The distance d3 is a distance sufficient to press the booklet BT down to the minimum thickness and complete it to a final thickness while each sheet of the booklet BT is stretched, that is, a distance enabling to press and fix the booklet BT.

Figure 13:
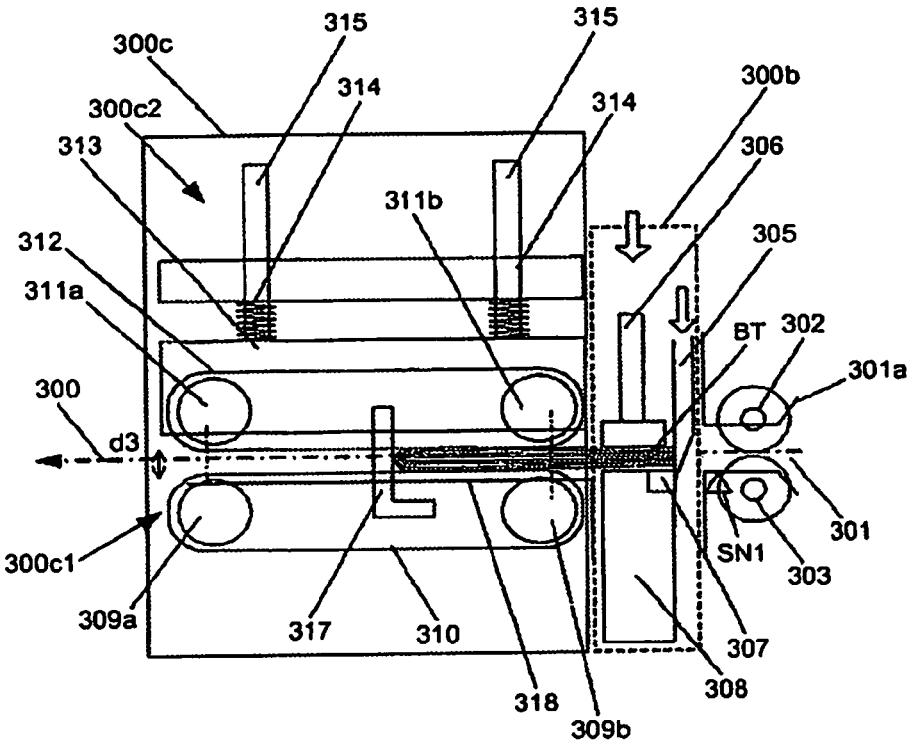
FIG. 13 is an operation explanatory diagram illustrating a cutting operation of the cutter, presented to illustrate an operation when the booklet is cut after being aligned.

FIG. 13 is an operation explanatory diagram illustrating an operation when the booklet is cut after being aligned. After the booklet BT is aligned in the position thereof and pressed to be fixed as illustrated in FIG. 12, the pressing member 306 provided near the upper cutting blade 305 is moved down to press the booklet BT near a cutting position thereof to the upper surface of the base 308 (Step S15), and the upper cutting blade 305 is moved down so as to cut the fore edge of the booklet BT between the upper cutting blade 305 and the lower cutting blade 307 (Step S16). Booklet scrap pieces cut from the fore-edge side are contained in the scrap receiver 320. The amount of downward movement of the pressing plate 316 at Step S14 is an amount that allows the compression springs 314 to apply sufficient pressing force to hold and fix each sheet, particularly the surface sheet, of the booklet BT so as not to be misaligned when the pressing plate 316 moves down and presses the fore-edge side of the booklet BT onto the upper surface of the base 308.

Figure 14:
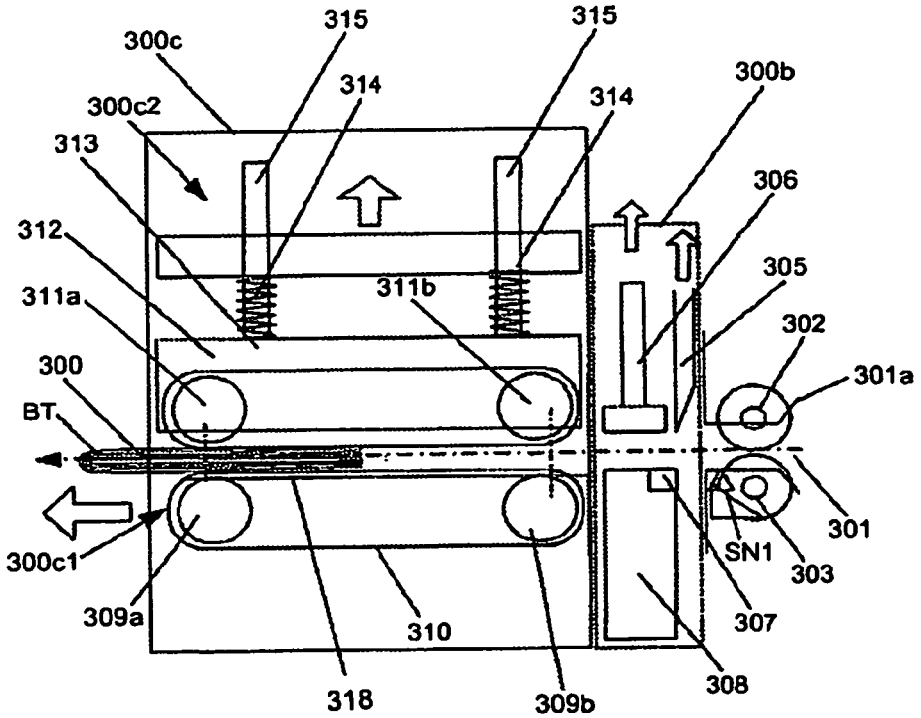
FIG. 14 is an operation explanatory diagram illustrating a cutting operation of the cutter, presented to illustrate an operation after the cutting is finished.

FIG. 14 is an operation explanatory diagram illustrating an operation after the cutting is finished. After the cutting illustrated in FIG. 13 is performed, the upper cutting blade 305 and the pressing member 306 are retracted from the cutting positions to the initial positions above (Step S17). Then, the pressing plate 316 and the upper unit 300*c*2 move up, and the pressure applied to the booklet BT is released until reaching a pressure allowing the booklet to be conveyed (Step S18). The upward movement distance at this time is determined corresponding to the booklet information such as the sheet thickness, the sheet size, the number of bound sheets, and the paper quality (such as special paper). Thereafter, the first and the second conveying belts 310 and 312 are rotated in the conveying direction (Step S19), and thus, the booklet BT cut at the fore edge thereof is discharged out of the cutter 3. Then, at the time when the discharge is completed (Step S20), a sequence of operations in the cutter 3 is completed.

The database that is referred to with respect to the first to the third distances d1, d2, and d3 at Steps S3, S10, and S13, and with respect to the amount of downward movement of the pressing plate 316 in Step S14 is formed as follows: by using an actual apparatus before shipment, the optimal values for the distances d1, d2, and d3 and the amount of downward movement are obtained in advance with respect to combinations of elements such as the sheet thickness, the sheet size, the number of bound sheets, and the paper type (such as special paper) of booklets BT that can be subjected to the cutting process in the cutter 3, and the obtained values are formed into the database. For example, when the CPU PR1 of the image forming apparatus PR sends to the CPU 351 of the cutter 3 the booklet information that the sheet thickness is normal thickness (thickness of normal paper when divided into thin paper, normal paper, and thick paper; represented by e.g., metric basis weight in g/m$^2$), the sheet size is A3, the number of bound sheets is 10, the paper type is plain paper, the CPU 351 refers to the database in the memory to obtain the first to the third distances d1, d2, and d3 and the amount of downward movement of the pressing plate 316 corresponding to the booklet information, and determines the first to the third distances d1, d2, and d3 and the amount of downward movement of the pressing plate 316 at Steps S3, S10, and S13 and at Step S14. This operation allows the cutting process to be performed in the state of holding the booklet BT with optimal holding force or pressing force.

By holding the booklet BT in this manner, deflection of the booklet BT is suppressed, and, when pressed by the pressing member, prevented from being misaligned. Accurate sheet processing can be thus achieved.

As described above, according to this embodiment, the following effects are produced.

1) When the booklet BT is pressed by the pressing member 306, cut, and bound, the booklet BT is more likely to be moved and misaligned during pressing as the height thereof is larger before being flattened. However, during the alignment of the booklet before pressure is applied, the distance between the first and the second conveying belts 310 and 312 provided below and above the booklet BT is changed to reduce the height of the booklet in advance and then the booklet is pressed. As a result, the misalignment of the booklet BT can be prevented or minimized during the pressing.

2) The surfaces of the first and the second conveying belts 310 and 312 coming in contact with the sheets use materials having low coefficients of friction, or are processed so as to have low coefficients of friction. In addition, the coefficients of friction of the first and the second conveying belts 310 and 312 are set to be almost equal to each other. The force applied to the upper side and the force applied to the lower side of the booklet are low, and the upper-side frictional force and the lower-side frictional force are almost equal to each other during the pressing. As a result, the misalignment can be eliminated or minimized when the booklet BT is pressed.

3) The first and the second conveying belts 310 and 312 contribute to the alignment of the booklet BT, and in addition, press the entire booklet in a supplemental manner during the cutting process. As a result, the pressing member 306 can apply the pressing force in a stable manner. The booklet BT can be thus prevented from being misaligned when the upper cutting blade 305 is in operation.

This embodiment is an example to which the cutting process of the cutter 3 is applied. However, in addition to this example, it is possible to perform a process to change the distance for holding the sheets in a stepwise manner in an apparatus to press and process the sheets during processes such as top-and-bottom cutting and square folding that performs a squaring process so that the spine portion of the booklet becomes flat.

The components in the claims correspond to the components in this embodiment as follows: the booklet in the claims to the reference numeral BT in this embodiment; the conveying unit to the pair of conveying rollers 302 and 303; the processing unit to the cutting unit 300*b* including the upper cutting blade 305 and the lower cutting blade 307; the booklet holding unit to the aligning unit 300*c* including the lower unit 300*c*1 and the upper unit 300*c*2; the pressing unit to the pressing member 306 and the base 308; the gap distance changing unit to an elevating mechanism (not illustrated) for the upper unit 300*c*2 (or pressing plate 316) and the CPU 351; the first distance to the reference numeral d1; the second distance to the reference numeral d2; the third distance to the reference numeral d3; the conveying belt to the first and the second conveying belts 310 and 312; the guide plate to the reference numeral 318; the positioning stopper to the reference numeral 317; the cutting unit to the upper cutting blade 305 and the lower cutting blade 307; the sheet processing apparatus to the cutter 3; and the image forming apparatus to the reference numeral PR.

According to the present invention, accurate sheet processing can be achieved by suppressing deflection and by preventing misalignment from occurring when a booklet is pressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a conveying unit that conveys a booklet formed by folding a sheet bundle;

a processing unit that performs a predetermined process on the booklet;

a booklet holding unit that includes first and second holding members to hold the booklet and varies a gap distance between the first and second holding members depending on a state of processing the booklet while the processing unit is performing the process on the booklet; and a pressing unit that presses and fixes the booklet while the processing unit is processing the booklet, wherein the gap distance between the first and second holding members is variably set to:

a first gap distance sufficient to convey the booklet by the first and second holding members;

a second gap distance that is smaller than the first distance and allows the booklet to be in contact with and move between the first and second holding members while an alignment is being performed on the booklet before being processed by the processing unit; and a third gap distance that is smaller than the second distance and sufficient to press and hold the booklet when being processed by the processing unit.

2. The sheet processing apparatus according to claim 1, further comprising a gap distance changing unit that moves one or both of the first and second holding members to have the first gap distance allowing conveyance of the booklet when being carried in, the second gap distance allowing the alignment to be performed on the booklet, and the third distance sufficient to hold the booklet in this order.

3. The sheet processing apparatus according to claim 1, wherein after the gap distance is set to the third distance, the booklet holding unit is made closer to the booklet, and a predetermined holding pressure is applied to the booklet.

4. The sheet processing apparatus according to claim 1, wherein contact surfaces of the first and second holding members that come in contact with the booklet are set to be low-friction surfaces having low coefficients of friction against sheets on upper and lower surfaces of the booklet, and the coefficients of friction of the contact surfaces are set to be almost equal to each other.

5. The sheet processing apparatus according to claim 1, wherein the gap distance is set based on booklet information including at least one of number of bound sheets, a sheet thickness, a sheet size, and a paper type.

6. The sheet processing apparatus according to claim 1, wherein the first and second holding members are conveying belts to convey the booklet or a guide plate guiding the sheet bundle while the booklet is being conveyed.

7. The sheet processing apparatus according to claim 1, wherein the alignment is performed on the booklet with respect to a positioning stopper arranged on a downstream side of the processing unit.

8. The sheet processing apparatus according to claim 1, wherein the processing unit is a cutting unit that cuts the booklet at a predetermined position.

9. An image forming system comprising:

the sheet processing apparatus according to claim 1; and an image forming apparatus forming an image on a sheet.

* * * * *